US006551151B2

(12) United States Patent
Suzuki

(10) Patent No.: US 6,551,151 B2
(45) Date of Patent: Apr. 22, 2003

(54) MALE TERMINAL WITH CURVED INTERCONNECTING PORTION

(75) Inventor: Kenji Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/968,777

(22) Filed: Oct. 3, 2001

(65) Prior Publication Data

US 2002/0039864 A1 Apr. 4, 2002

(30) Foreign Application Priority Data

Oct. 4, 2000 (JP) ..... 2000-304738

(51) Int. Cl.[7] ..... H01R 4/10
(52) U.S. Cl. ..... 439/877; 439/866; 439/884
(58) Field of Search ..... 439/877, 884, 439/866, 886

(56) References Cited

U.S. PATENT DOCUMENTS 5,591,054 A * 1/1997 Okada et al. ..... 439/884
5,664,974 A * 9/1997 Endo et al. ..... 439/884
5,989,079 A * 11/1999 Seko et al. ..... 439/884
6,238,252 B1 * 5/2001 Flieger ..... 439/884

* cited by examiner

*Primary Examiner*—Tho D. Ta
(74) *Attorney, Agent, or Firm*—Sughrue Mion, PLLC

(57) ABSTRACT

A male terminal (1) includes an interconnecting portion (12) interconnecting a box-like portion (9) and an electrical contact portion (5). The interconnecting portion (12) includes an upper wall surface portion (12*c*), extending from one free side edge portion (6) to the box-like portion (9). The interconnecting portion (12) further includes a side wall surface portion (12*b*) bent outwardly from the upper wall surface portion (12*c*), and a bottom wall surface portion (12*a*) extending from a bottom plate portion (7) of the electrical contact portion (5) to the box-like portion (9). The upper wall surface portion (12*c*) and the side wall surface portion (12*b*) are bent outwardly toward the bottom wall surface portion (12*a*). An area of intersection of the upper wall surface portion (12*c*) and the electrical contact portion (5) is defined by a curved surface.

8 Claims, 5 Drawing Sheets

MALE TERMINAL WITH CURVED INTERCONNECTING PORTION

BACKGROUND OF THE INVENTION

1. Field of the Invention

The present invention relates to a male terminal for a connector, in which an electrical contact portion of the male type has an increased strength.

The present application is based on Japanese Patent Application No. 2000-304738, which is incorporated herein by reference.

2. Description of the Related Art

FIG. 6 shows a related male terminal. This male terminal 60 includes an electrical contact portion 61 of the male type, formed at one end thereof so as to contact a mating terminal, and a wire connection portion 62 which is formed at the other end thereof, and is pressed to be grippingly connected to an electric wire 50. The male electrical contact portion 61 extends straight in the longitudinal direction. The wire connection portion 62 includes a wire conductor connection portion 64 for press-clamping (gripping) a conductor portion of the electric wire 50, and a wire sheath connection portion 63 for press-clamping a sheath of the electric wire 50, and these connection portions 64 and 63 are arranged on a line in adjacent relation to each other in the longitudinal direction. The wire conductor connection portion 64 includes a pair of clamping piece portions 64*a*, extending upwardly respectively from opposite side edges of a base plate of the terminal, and has a U-shaped cross-section. Similarly, the wire sheath connection portion 63 includes a pair of clamping piece portions 63*a* extending upwardly respectively from the opposite side edges of the base plate, and has a U-shaped cross-section. A box-like portion 65 of a generally rectangular cross-section is formed between the male electrical contact portion 61 and the wire connection portion 62, and this box-like portion 65 includes a bottom wall 65*a*, side walls 65*b*, extending upwardly respectively from opposite side edges of the bottom wall 65*a*, and a top wall 65*c* extending between the two side walls 65*b* in a bridging manner. A stabilizing plate 66 for preventing the reverse insertion of the terminal into a cavity is formed in a projected manner on the bottom wall 65*a* intermediate opposite ends thereof, and an engagement hole 66*a* for engagement with a retaining lance 71 is formed in the bottom wall 65*a* at a front end of the stabilizing plate 66. The male terminal 60 is primarily retained within a connector housing 70 by the retaining lance 71, and the male terminal 60 has a retaining portion 78 through which the male terminal 60 is secondarily retained by a spacer 72. An inter connecting portion 79 is formed forwardly of this retaining portion 78, and has a tapering peripheral surface, and this interconnecting portion 79 is integrally connected to the male electrical contact portion 61.

This male terminal 60 is received in the connector housing 70, and is fitted in the female terminal (mating terminal) 75, and this condition is shown in FIGS. 7 and 8. The male terminal 60 is inserted in a tubular portion 76 of the female terminal 75, and is held in contact with a resilient contact piece portion provided within the tubular portion 76. Here, a connector, having the male terminals received in its connector housing, is defined as a female connector while a connector, having the female terminals received in its connector housing, is defined as a male connector. A fitting chamber is formed in the female connector 68, and this female connector 68 can be releasably fitted on the male connector 66 through a lock arm 77.

In the above-described male terminal, however, there is a possibility that the electrical contact portion of the male terminal is bent for some reason before or when it is received in the connector housing. For example, when the male terminal is pressed to be connected to the electric wire, a pressing force acts on the wire connection portion, and therefore there is a possibility that the electrical contact portion is warped upwardly or downwardly. Even if such upward or downward warp is not encountered, there is a possibility that the electrical contact portion is bent at its proximal end when the male terminal is received in the connector housing. In this condition, when the male terminal is fitted into the female terminal, the distal end portion of the electrical contact portion is disposed out of position with respect to the female terminal, so that the electrical contact portion may incompletely contact the female terminal. When the male terminal is forcibly inserted, there is a possibility that the distal end portion of the electrical contact portion is damaged or broken. And besides, it is expected that the strength of the proximal end portion of the electrical contact portion decreases in the future because of a thin design of a printed circuit board and a small-size design of the terminal, and this problem is important also from this point of view. Heretofore, a bead has been formed at the proximal end of the electrical contact portion to thereby secure the strength. However, this is not sufficient, and a more effective countermeasure has been desired.

In order to solve the above problem, there has been proposed a method in which the bending/deformation of the electrical contact portion is beforehand examined, and is corrected. However, such a method requires much time and labor, and the correction is not sufficient, and therefore a simple and easy countermeasure has been desired.

SUMMARY OF THE INVENTION

With the above problem in view, it is an object of the present invention to provide a male terminal in which an interconnecting portion, disposed adjacent to an electrical contact portion, is improved to thereby increase the strength of the electrical contact portion so that the bending and deformation of the electrical contact portion can be prevented.

Another object of the present invention is to provide a male terminal in which an electrical contact portion has an increased strength so as to meet a thin design of a printed circuit board and a small-size design of the male terminal.

To achieve the above objects, according to a first aspect of the present invention, there is provided a male terminal which comprises a terminal body, a wire connection portion, to which an electric wire is connectable, formed at one end portion of the terminal body, a male-type electrical contact portion, to which a mating female terminal is electrically connectable, formed at the other end portion of the terminal body, a box-like portion provided between the wire connection portion and the electrical contact portion, and an interconnecting portion interconnecting the box-like portion and the electrical contact portion, the interconnecting portion being formed into a curved surface.

In the first aspect of the present invention, the interconnection portion, interconnecting the box-like portion and the electrical contact portion, has the curved surface. Therefore, even if a bending force, developing when the male terminal is inserted obliquely into the female terminal or when the mating terminals are out of alignment with each other, is prevented from acting on the proximal end portion of the cantilever-type male terminal in a localized manner.

According to a second aspect of the present invention, there is provided a male terminal which comprises:

a wire connection portion to which an electric wire is connectable;

a male-type electrical contact portion, to which a mating female terminal is electrically connectable, including a bottom plate portion, the electrical contact portion being formed by bending one free side edge portion of the bottom plate portion thereof;

a box-like portion provided between the wire connection portion and the electrical contact portion; and an interconnecting portion interconnecting the box-like portion and the electrical contact portion, the interconnecting portion including:

an upper wall surface portion extending from the one free side edge portion to the box-like portion, a side wall surface portion bent outwardly from the upper wall surface portion, and a bottom wall surface portion extending from the bottom plate portion of the electrical contact portion to the box-like portion, wherein the upper wall surface portion of the interconnecting portion is bent toward the bottom wall surface portion of the interconnecting portion and extends in a peripheral direction of the interconnecting portion, and wherein an area of intersection of the upper wall surface portion and the electrical contact portion is defined by a curved surface.

In the second aspect of the present invention, the interconnecting portion, interconnecting the box-like portion and the electrical contact portion, includes the upper wall surface portion, extending from the one free side edge portion to the box-like portion, and the side wall surface portion bent outwardly from the upper wall surface portion, and the upper wall surface portion is bent toward the bottom wall surface portion, extending from the bottom plate portion of the electrical contact portion to the box-like portion, and extends in the peripheral direction. With this construction, the interconnecting portion has a hollow cross-sectional shape, and the directional dependency for lateral bending is reduced, and the cross-section performance is enhanced. The area of intersection of the upper wall surface portion and the electrical contact portion is defined by the curved surface, and therefore a force will not act on the proximal end of the electrical contact portion in a localized manner.

According to a third aspect of the present invention, it is preferable that the upper wall surface portion has one of an upwardly-slanting curved surface and an upwardly-slanting surface, which is gradually slanted toward the box-like portion from the one free side edge portion, and the bottom wall surface portion has a flat surface disposed in coplanar relation to the bottom plate portion of the electrical contact portion.

In the third aspect of the present invention, the upper wall surface portion has the upwardly-slanting surface, and the bottom wall surface portion has the flat surface disposed in coplanar relation to the bottom plate portion. The interconnecting portion has a tapering shape not over the entire periphery thereof, but over a generally half of the periphery thereof. Therefore, as compared with the male terminal discussed in the related art, the outer diameter of the tab portion can be made larger to have an increased rigidity. And besides, the interconnection portion is larger in thickness than the tab portion, and therefore bending and deformation can be prevented.

According to a fourth aspect of the present invention, it is preferable that the interconnecting portion further includes a pair of side walls extended upward from opposite side portions of the bottom wall surface portion, and wherein the upper wall surface portion of the interconnecting portion is extended from one of the side walls, and the side wall surface portion of the interconnecting portion is bent outwardly from the upper wall surface portion to cover at least a portion of the other one of the side walls.

BRIEF DESCRIPTION OF THE DRAWINGS

The above and other objects and advantages of the present invention will become more apparent by describing in detail a preferred embodiments thereof with reference to the accompanying drawings, wherein.

DETAILED DESCRIPTION OF THE PREFERRED EMBODIMENT

A preferred embodiment of the present invention will now be described in detail with reference to FIGS. 1 to 5.

FIGS. 1 to 5 shows one preferred embodiment of a male terminal of the present invention. With respect to those portions, already described above in the "Description of the Related Art" section, explanation will be partly omitted.

Figure 1:
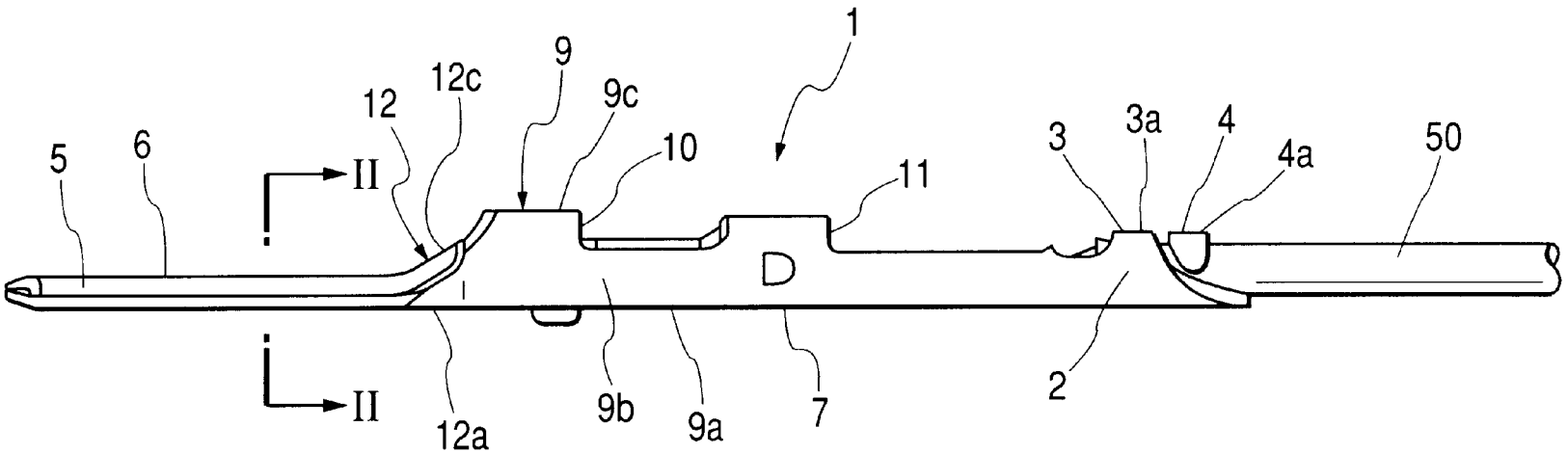
FIG. 1 is a side-elevational view of one preferred embodiment of a male terminal of the present invention.

As shown in FIG. 1, the male terminal 1 comprises a terminal body including a wire connection portion 2 for connection to an electric wire 50, a tab portion (electrical contact portion of the male type) 5 for electrical connection to a mating terminal, a box-like portion 9 provided between the wire connection portion 2 and the tab portion 5, and an interconnecting portion 12 interconnecting the box-like portion 9 and the tab portion 5.

The wire connection portion 2 includes a wire conductor connection portion 3, and a wire sheath connection portion 4 which are arranged on a line in adjacent relation to each other in the longitudinal direction. The wire conductor connection portion 2 includes a pair of clamping piece portions 3*a* and 4*a* extending upwardly respectively from opposite side edges of a bottom plate portion 7, and has a U-shaped cross-section. The box-like portion 9 includes a lower wall portion 9*a*, side wall portions 9*b* extending upwardly respectively from opposite side edges of this lower wall portion 9*a*, and an upper wall portion 9*c* extending between the pair of side wall portions 9*b* in a bridging manner, and this box-like portion 9 is formed into a box-like shape. The box-like portion 9 has a primary retaining portion 10 provided at its front end portion (disposed forwardly of a central portion thereof), and also has a secondary retaining portion 11 provided at a rear end surface thereof. The primary retaining portion 10 can be retained by an elastic retaining lance 32, formed on an inner surface of a terminal receiving chamber 31, and the secondary retaining portion 11 can be retained by a spacer 35. The tab portion 5 is formed at the front end of the box-like portion 9 through the interconnecting portion 12.

Figure 2:
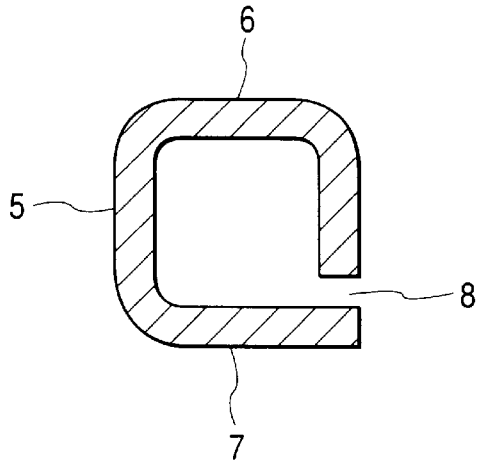
FIG. 2 is a cross-sectional view of the male terminal taken along the line II-II of FIG. 1.

The tab portion 5 is of a hollow construction, and has a rectangular cross-section, and this tab portion 5 is formed by bending one free side edge portion 6. This tab portion is thus formed into a rectangular cross-section so that it can be brought into surface-to-surface contact with a resilient contact piece portion (not shown), provided within a tubular portion 21 of a female terminal 20, and that the directional dependency for bending can be reduced so as to increase the strength. A gap 8 is formed between an edge end of the bottom plate portion 7 and an end of the one free side edge portion 6. The gap 8 is thus formed between the opposed edge ends as shown in FIG. 2 so that the tab portion 5 can have a spring nature so as to be easily connected to the female terminal 20 and that the good electrical contact can be achieved. The gap 8 is provided at the lateral side, so that the surface, having no gap, can serve as the contact surface. Generally, the tab portion 5 is defined by a tab portion of a flat plate-like cross-section, and there is no problem even if the tab portion has such a cross-section shape. Examples of such known tab portions of a flat plate-like cross-section include one in which opposite side edge portions of a bottom plate portion are bent inwardly toward each other, with butted edge ends disposed at the upper side or the lower side, one in which one free side edge portion is bent laterally, with both edge ends directed laterally, and one comprising a single solid plate or sheet.

Figure 3:
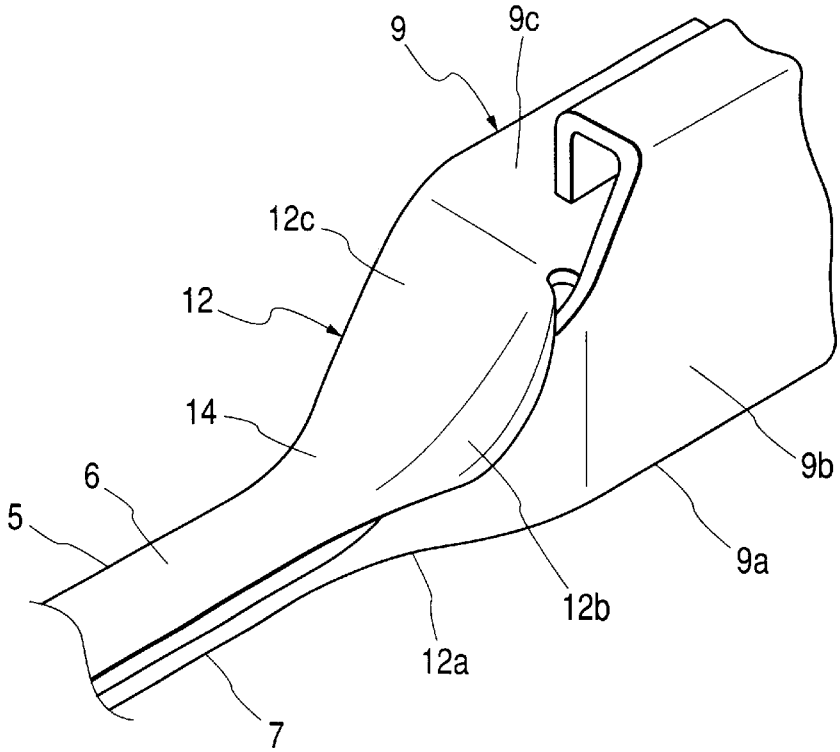
FIG. 3 is a fragmentary, perspective view showing an interconnecting portion of the male terminal of FIG. 1 on an enlarged scale.

As shown in FIG. 3, the interconnecting portion 12 includes an upper wall surface portion 12*c*, extending from the one free side edge portion 6 to the box-like portion 9, a side wall surface portion 12*b*, bent outwardly from the upper wall surface portion 12*c*, and a bottom wall surface portion 12*a* extending from the bottom plate portion 7 of the tab portion 5 to the box-like portion 9. The upper wall surface portion 12*c* is bent toward the bottom wall surface portion 12*a*, and extends in the peripheral direction. The side wall surface portion 12*b* is disposed in overlapping relation to the side wall portion 9*b* of the box-like portion 9. The upper wall surface portion 12*c* has an upwardly-slanting curved surface or an upwardly-slanting surface, which is gradually slanted toward the box-like portion 9. The bottom wall surface portion 12*a* has a flat surface flush with or coplanar with the bottom plate portion 7. With this construction, the interconnecting portion 12 has a hollow cross-sectional shape, and has a tapering shape over a generally half of the periphery. Here, the hollow cross-sectional shape is adopted in view of a second moment of area. Namely, the directional dependency for lateral bending and the cross-section performance are taken into consideration. The interconnecting portion has the tapering shape not over the entire periphery thereof, but over the generally half of the periphery thereof. The reason is that if it has the tapering shape over the entire periphery, the outer diameter of the tab portion is small, and is reduced in strength. Particularly when the terminal has a small size, the tab portion is liable to be bent or deformed.

The one free side edge portion 6 of the tab portion 5 is formed integrally with the upper wall surface portion 12*c* of the interconnecting portion 12 in continuous relation thereto, and an area 14 of intersection of the two is defined by a curved surface. With this construction, even if a bending force acts on the tab portion when the male terminal is inserted obliquely or when the two mating terminals are out of alignment with each other, a stress will not develop at the intersection area 14 in a localized manner.

Figure 4:
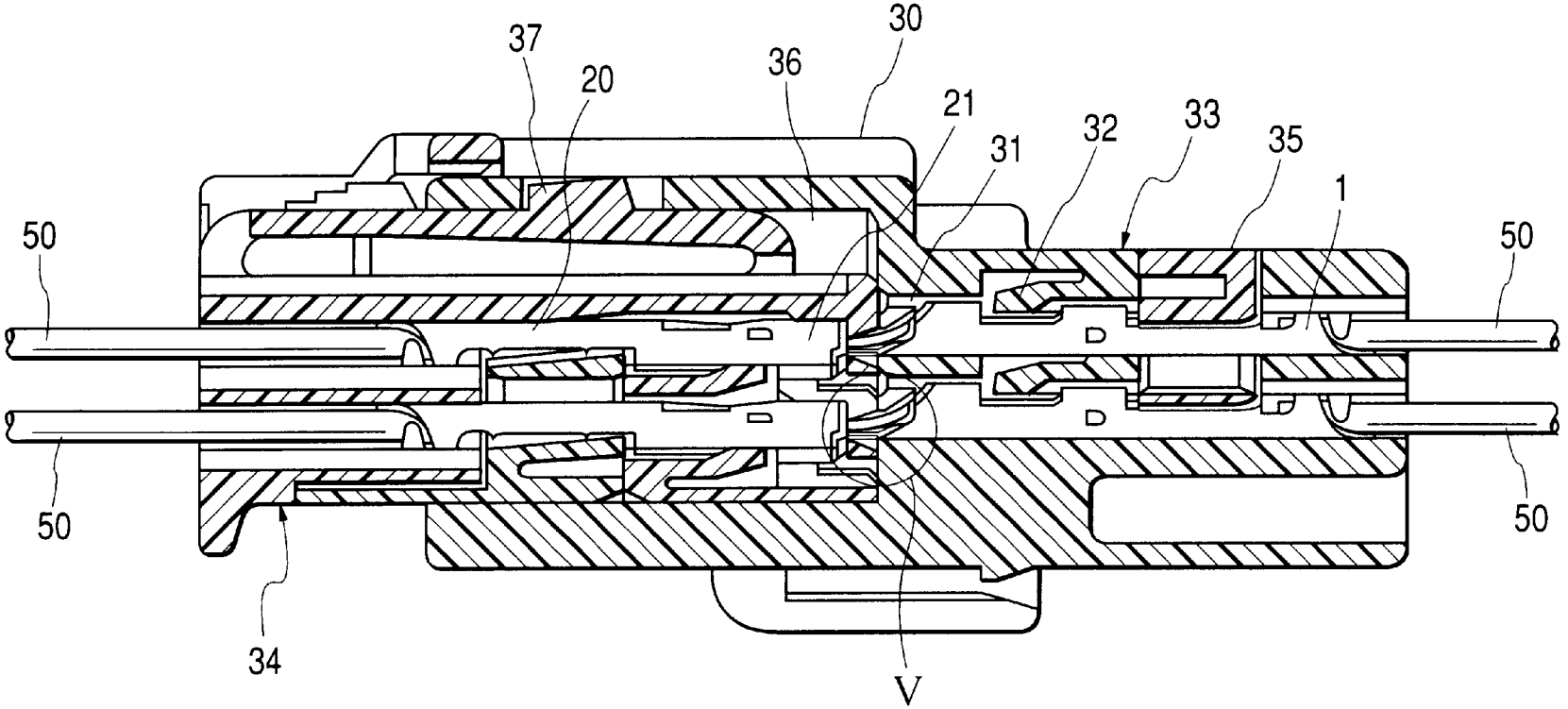
FIG. 4 is a cross-sectional view showing a condition in which the male terminals of FIG. 1 are connected to female terminals, respectively.
Figure 5:
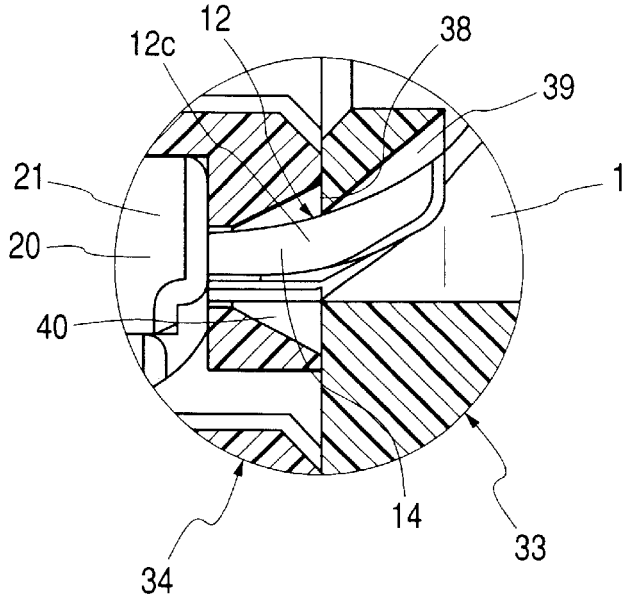
FIG. 5 is an enlarged view of a portion V of FIG. 4.
Figure 6:
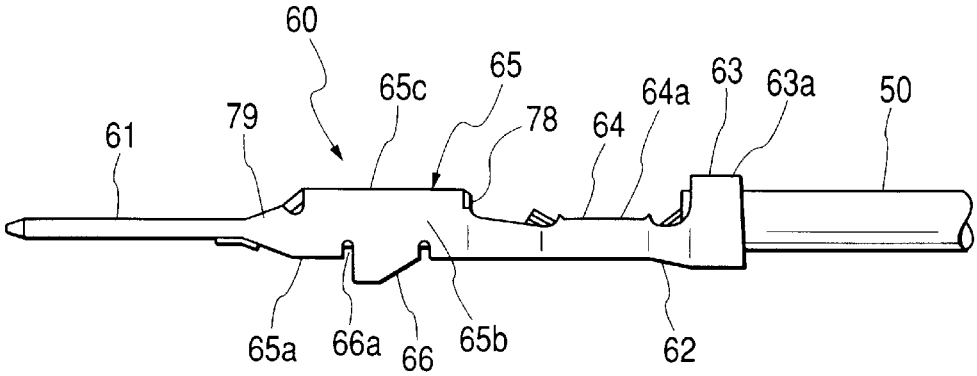
FIG. 6 is a side-elevational view of a related male terminal.
Figure 7:
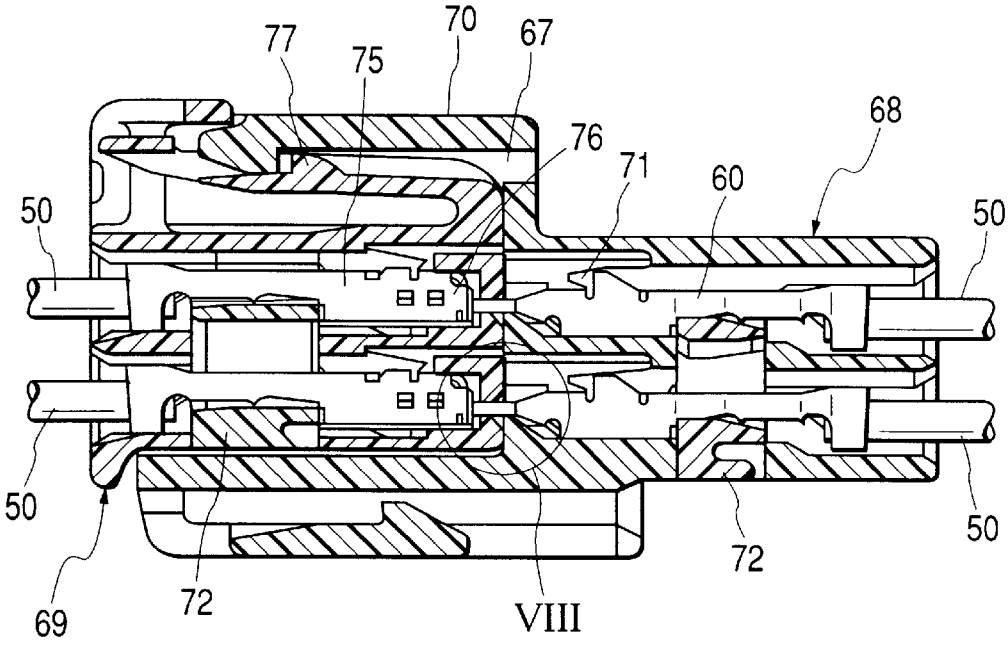
FIG. 7 is a cross-sectional view showing a condition in which the male terminals of FIG. 6 are connected to female terminals, respectively.
Figure 8:
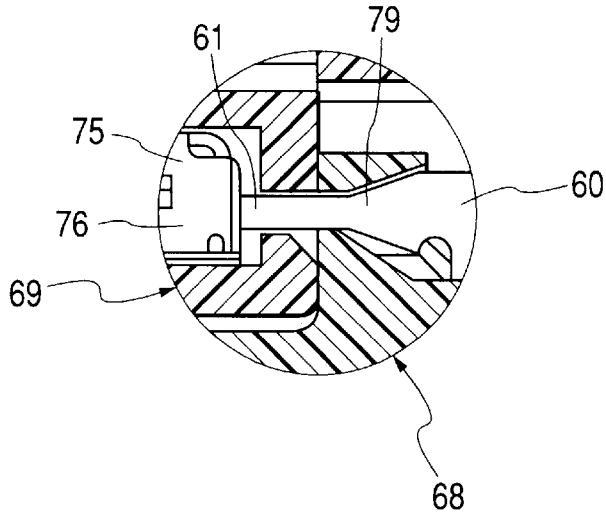
FIG. 8 is an enlarge view of a portion VIII of FIG. 7.

The female connector 33, having the male terminals 1 received in its connector housing 30, is fitted on the male connector 34 having the female terminals 20 received therein. This condition is shown in FIGS. 4 and 5. As described above in the section "Description of the Related Art", the female terminal 20, like the male terminal 1, is primarily retained by an elastic retaining lance 32, and is secondarily retained by a spacer 35. The female terminal 20 has at its rear end a wire connection portion 2 for press-clamping an electric wire 50, and also has at its front end the tubular portion 21 having an open end for receiving the tab portion 5 of the male terminal 1. The resilient contact piece portion (not shown) of an arch-shape is provided within the tubular portion 21, and can electrically contact the tab portion 5. A fitting chamber 36 is formed in the female connector 33, and this female connector 33 can be releasably fitted on the male connector 34 through a lock arm 37.

As shown in FIG. 5, the interconnecting portion 12 of the male terminal 1 is disposed at a frontage portion 38 of the female connector 33. A terminal insertion hole 39 is formed in the frontage portion 38, and this terminal insertion hole 39 serves to guide the distal end portion of the tab portion 5 straight and also to hold the proximal end of the tab portion is formed in the frontage portion 38. An inner surface of the terminal insertion hole 39 conforms in shape to the proximal end portion and interconnecting portion 12 of the tab portion 5. On the other hand, a frontage portion 40 of the female connector 34 has a dish-shaped hole. The interconnecting portion 12 is thus disposed at the frontage portion 38 for the purpose of enhancing the strength of the tab portion 5. Namely, when a lateral bending force acts on the tab portion 5 of the cantilever type, that portion of the tab portion, located at the frontage portion 38 serving as an end-fixing portion, is most liable to be damaged, and therefore to enhance the strength of this portion is very effective against bending.

Although the above embodiment is directed to the male terminal in the form of a press-clamping terminal which is pressed to be grippingly connected to the electric wire, the present invention can be applied to a press-connecting terminal which is press-connected to an electric wire.

As described above, in the embodiment, the interconnection portion, interconnecting the box-like portion and the electrical contact portion, has the curved surface. Therefore, even if a bending force, developing when the male terminal is inserted obliquely into the female terminal or when the mating terminals are out of alignment with each other, is prevented from acting on the proximal end portion of the cantilever-type male terminal in a localized manner. Therefore, the tab portion of the male terminal has the increased strength, and is prevented from bending and deformation.

In the embodiment, the interconnecting portion, interconnecting the box-like portion and the electrical contact portion, includes the upper wall surface portion, extending from the one free side edge portion to the box-like portion, and the side wall surface portion bent outwardly from the upper wall surface portion, and the upper wall surface portion is bent toward the bottom wall surface portion, extending from the bottom plate portion of the electrical contact portion to the box-like portion, and extends in the peripheral direction. With this construction, the interconnecting portion has a hollow cross-sectional shape, and the directional dependency for lateral bending is reduced, and the cross-section performance is enhanced. The area of intersection of the upper wall surface portion and the electrical contact portion is defined by the curved surface, and therefore a force will not act on the proximal end of the electrical contact portion in a localized manner. Therefore, the male terminal has the increased strength, and the male and female terminals can be kept in a good contacted condition. And besides, the terminal will not be deformed, and therefore the electrically-connected condition will not be affected.

In the embodiment, the upper wall surface portion has the upwardly-slanting surface, and the bottom wall surface portion has the flat surface disposed in coplanar relation to the bottom plate portion. The interconnecting portion has a tapering shape not over the entire periphery thereof, but over a generally half of the periphery thereof. Therefore, as compared with the male terminal discussed as the related art, the outer diameter of the tab portion can be made larger to have an increased rigidity. And besides, the interconnection portion is larger in thickness than the tab portion, and therefore bending and deformation can be prevented. Particularly, the sufficient strength of the tab portion can be secured even when a printed circuit board has a thin design and when the male terminal has a small-size design.

It is contemplated that numerous modifications may be made to the male terminal of the present invention without departing from the spirit and scope of the invention as defined in the following claims.

What is claimed is:

1. A male terminal, comprising:

a terminal body;

a wire connection portion, to which an electric wire is connectable, formed at one end portion of the terminal body;

a male-type electrical contact portion, to which a mating female terminal is electrically connectable, formed at the other end portion of the terminal body;

a box-like portion provided between the wire connection portion and the electrical contact portion; and an interconnecting portion interconnecting the box-like portion and the electrical contact portion, an intersection area between the interconnecting portion and the male-type electrical contact portion is defined by a curved surface, wherein said intersection area of said interconnection portion has a hollow lateral cross section.

2. A male terminal, comprising:

a wire connection portion to which an electric wire is connectable;

a male-type electrical contact portion, to which a mating female terminal is electrically connectable, including a bottom plate portion, the electrical contact portion being formed by bending one free side edge portion of the bottom plate portion thereof;

a box-like portion provided between the wire connection portion and the electrical contact portion; and an interconnecting portion interconnecting the box-like portion and the electrical contact portion, the interconnecting portion including:

an upper wall surface portion extending from the one free side edge portion to the box-like portion, a side wall surface portion bent outwardly from the upper wall surface portion, and a bottom wall surface portion extending from the bottom plate portion of the electrical contact portion to the box-like portion, wherein the upper wall surface portion of the interconnecting portion is bent toward the bottom wall surface portion of the interconnecting portion and extends in a peripheral direction of the interconnecting portion, wherein an area of intersection of the upper wall surface portion and the electrical contact portion is defined by a curved surface, and wherein said area of intersection has a hollow lateral cross section.

3. The male terminal of claim 2, wherein the interconnecting portion further includes a pair of side walls extended upward from opposite side portions of the bottom wall surface portion, and wherein the upper wall surface portion of the interconnecting portion is extended from one of the side walls, and the side wall surface portion of the interconnecting portion is bent outwardly from the upper wall surface portion to overlap at least a portion of the other one of the side walls.

4. The male terminal of claim 2, wherein the electrical contact portion comprises four sides.

5. The male terminal of claim 2, wherein the upper wall surface portion has one of an upwardly-slanting curved surface and an upwardly-slanting surface, which is gradually slanted toward the box-like portion from the one free side edge portion, and the bottom wall surface portion has a flat surface disposed in coplanar relation to the bottom plate portion of the electrical contact portion.

6. The male terminal of claim 5, wherein the interconnecting portion further includes a pair of side walls extended upward from opposite side portions of the bottom wall surface portion, and wherein the upper wall surface portion of the interconnecting portion is extended from one of the side walls, and the side wall surface portion of the interconnecting portion is bent outwardly from the upper wall surface portion to overlap at least a portion of the other one of the side walls.

7. The male terminal of claim 2, wherein the upper wall surface portion has an upwardly-slanting curved surface in a longitudinal cross section, and the bottom wall surface portion has a flat surface disposed in coplanar relation to the bottom plate portion of the electrical contact portion.

8. The male terminal of claim 7, wherein the interconnecting portion further includes a pair of side walls extended upward from opposite side portions of the bottom wall surface portion, and wherein the upper wall surface portion of the interconnecting portion is extended from one of the side walls, and the side wall surface portion of the interconnecting portion is bent outwardly from the upper wall surface portion to overlap at least a portion of the other one of the side walls.

* * * * *